US009675856B1

(12) United States Patent
Gibbs et al.

(10) Patent No.: US 9,675,856 B1
(45) Date of Patent: Jun. 13, 2017

(54) GOLF CLUB HEAD WITH ADJUSTABLE CENTER OF GRAVITY

(71) Applicant: CALLAWAY GOLF COMPANY, Carlsbad, CA (US)

(72) Inventors: Evan D. Gibbs, Encinitas, CA (US); Christopher A. G. Nunez, Escondido, CA (US); Denver Holt, Carlsbad, CA (US); Justin Del Rosario, Temecula, CA (US); Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 39 days.

(21) Appl. No.: 14/884,027

(22) Filed: Oct. 15, 2015

Related U.S. Application Data

(63) Continuation-in-part of application No. 14/153,722, filed on Jan. 13, 2014, now Pat. No. 9,199,145, which
(Continued)

(51) Int. Cl.
*A63B 53/04* (2015.01)
*A63B 53/06* (2015.01)

(52) U.S. Cl.
CPC ..... *A63B 53/06* (2013.01); *A63B 53/0466* (2013.01); *A63B 2053/0495* (2013.01)

(58) Field of Classification Search
USPC ..... 473/324–350
See application file for complete search history.

(56) References Cited

U.S. PATENT DOCUMENTS 2,219,670 A * 10/1940 Wettlaufer ..... A63B 53/06 473/247
4,213,613 A * 7/1980 Nygren ..... A63B 53/04 473/327

(Continued)

FOREIGN PATENT DOCUMENTS

JP 2002320691 A * 11/2002
JP 2003236025 A * 8/2003

(Continued)

OTHER PUBLICATIONS

TaylorMade SLDR Driver. [online]. [retrieved on Aug. 7, 2013]. Retrieved from the Internet: <URL:http://taylormadegolf.com/taylormade/sldr-driver/DW-SQ035.html>.

(Continued)

*Primary Examiner* — Alvin Hunter
(74) *Attorney, Agent, or Firm* — Rebecca Hanovice; Michael Catania; Sonia Lari

(57) ABSTRACT

A golf club head comprising a channel and a sliding weight that can be reversibly fixed at any point within the channel is disclosed herein. The channel preferably is disposed on the sole and extends from a heel side of the golf club head, around a rear side, and ends at a toe side of the golf club head. This channel is not constrained to a planar arc, but instead twists as it extends around the golf club head so that it follows the contours, and preserves the aesthetics, of the golf club head. The slidable weight comprises a base portion and a first cap, and a second cap that has the same dimensions as, and is interchangeable with, the first cap is disposed in a pocket in the sole proximate the face of the golf club head.

19 Claims, 9 Drawing Sheets

Related U.S. Application Data is a continuation of application No. 14/033,218, filed on Sep. 20, 2013, now Pat. No. 8,696,491, which is a continuation-in-part of application No. 13/923,571, filed on Jun. 21, 2013, now Pat. No. 9,084,921, which is a continuation-in-part of application No. 13/778,958, filed on Feb. 27, 2013, now Pat. No. 8,894,506.

(60) Provisional application No. 61/727,608, filed on Nov. 16, 2012.

(56) References Cited

U.S. PATENT DOCUMENTS

| | | | | |
|---|---|---|---|---|
| 5,688,189 | A | 11/1997 | Bland | |
| 5,735,754 | A * | 4/1998 | Antonious | A63B 53/04 473/328 |
| 5,851,155 | A * | 12/1998 | Wood | A63B 53/02 473/246 |
| 6,015,354 | A | 1/2000 | Ahn et al. | |
| 6,348,013 | B1 * | 2/2002 | Kosmatka | A63B 53/04 473/329 |
| 6,368,230 | B1 * | 4/2002 | Helmstetter | A63B 53/02 473/244 |
| 6,379,264 | B1 | 4/2002 | Forzano | |
| 6,575,845 | B2 * | 6/2003 | Smith | A63B 53/02 473/329 |
| 6,749,523 | B1 | 6/2004 | Forzano | |
| 7,108,609 | B2 | 9/2006 | Stites et al. | |
| 7,147,573 | B2 | 12/2006 | DiMarco | |
| 7,166,041 | B2 * | 1/2007 | Evans | A63B 53/0466 473/334 |
| 7,201,669 | B2 | 4/2007 | Stites et al. | |
| 7,294,064 | B2 * | 11/2007 | Tsurumaki | A63B 53/0466 473/329 |
| 7,500,924 | B2 * | 3/2009 | Yokota | A63B 53/0466 473/332 |
| 7,520,820 | B2 | 4/2009 | DiMarco | |
| 7,572,193 | B2 * | 8/2009 | Yokota | A63B 53/0466 473/328 |
| 7,611,424 | B2 * | 11/2009 | Nagai | A63B 53/0466 473/334 |
| 7,775,905 | B2 * | 8/2010 | Beach | A63B 53/0466 473/256 |
| 7,824,280 | B2 * | 11/2010 | Yokota | A63B 53/0466 473/334 |
| 7,854,667 | B2 | 12/2010 | Gillig | |
| 7,927,231 | B2 | 4/2011 | Sato et al. | |
| 7,988,565 | B2 * | 8/2011 | Abe | A63B 53/0466 473/328 |
| 8,016,694 | B2 * | 9/2011 | Llewellyn | A63B 53/0466 473/334 |
| 8,192,303 | B2 | 6/2012 | Ban | |
| 8,202,175 | B2 * | 6/2012 | Ban | A63B 53/0466 473/334 |
| 8,216,087 | B2 | 7/2012 | Breier et al. | |
| 8,308,583 | B2 * | 11/2012 | Morris | A63B 53/0487 473/335 |
| 8,403,771 | B1 * | 3/2013 | Rice | A63B 53/04 473/328 |
| 8,435,134 | B2 * | 5/2013 | Tang | A63B 53/04 473/329 |
| 8,444,505 | B2 | 5/2013 | Beach et al. | |
| 8,517,860 | B2 * | 8/2013 | Albertsen | A63B 53/0466 473/329 |
| 8,696,491 | B1 * | 4/2014 | Myers | A63B 53/06 473/334 |
| 8,821,312 | B2 * | 9/2014 | Burnett | A63B 53/0466 473/329 |
| 8,834,289 | B2 * | 9/2014 | de la Cruz | A63B 53/0466 473/329 |
| 8,834,290 | B2 * | 9/2014 | Bezilla | A63B 53/0466 473/329 |
| 8,858,360 | B2 * | 10/2014 | Rice | A63B 53/04 473/329 |
| 8,888,607 | B2 * | 11/2014 | Harbert | A63B 53/04 473/307 |
| 8,894,506 | B1 * | 11/2014 | Myers | A63B 53/0466 473/334 |
| 8,961,332 | B2 * | 2/2015 | Galvan | A63B 53/04 473/329 |
| 2006/0122004 | A1 | 6/2006 | Chen et al. | |
| 2006/0240908 | A1 | 10/2006 | Adams et al. | |
| 2008/0020861 | A1 * | 1/2008 | Adams | A63B 53/04 473/334 |
| 2010/0075773 | A1 * | 3/2010 | Casati, Jr. | A63B 49/02 473/334 |
| 2010/0292027 | A1 | 11/2010 | Beach et al. | |

FOREIGN PATENT DOCUMENTS

| | | | |
|---|---|---|---|
| JP | 2005-323978 | | 11/2005 |
| JP | 2005323978 | A * | 11/2005 |
| JP | 2006/238022 | | 9/2006 |
| JP | 2006-320493 | | 11/2006 |
| JP | 2006320493 | A * | 11/2006 |
| JP | 2010252964 | A * | 11/2010 |
| JP | 2011010722 | A * | 1/2011 |
| JP | 2011229914 | A * | 11/2011 |

OTHER PUBLICATIONS

Kick X Golf Tracker SRT. [online]. [retrieved on Aug. 7, 2013]. Retrieved from the Internet: <URL:http://kickxgolf.com/tracker-srt.aspx>.

* cited by examiner

GOLF CLUB HEAD WITH ADJUSTABLE CENTER OF GRAVITY

CROSS REFERENCES TO RELATED APPLICATIONS

The present application is a continuation-in-part of U.S. patent application Ser. No. 14/153,722, filed on Jan. 13, 2014, which is a continuation of U.S. patent application Ser. No. 14/033,218, filed on Sep. 20, 2013, and issued on Apr. 15, 2014, as U.S. Pat. No. 8,696,491, which is a continuation-in-part of U.S. patent application Ser. No. 13/923,571, filed on Jun. 21, 2013, and issued on Jul. 21, 2015, as U.S. Pat. No. 9,084,921, which is a continuation-in-part of U.S. patent application Ser. No. 13/778,958, filed on Feb. 27, 2013, and issued on Nov. 25, 2014, as U.S. Pat. No. 8,894,506, which claims priority to U.S. Provisional Patent Application No. 61/727,608, filed on Nov. 16, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a weight for a golf club head that can be adjusted along a continuous channel.

Description of the Related Art

The ability to adjust center of gravity location and weight in the head of driving clubs is useful for controlling performance of the golf club. The prior art includes several different solutions for adjustable weighting, but these solutions do not optimize weight adjustment. There is a need for a weighting mechanism that allows for simple and flexible center of gravity (CG) and moment of inertia (MOI) adjustability.

BRIEF SUMMARY OF THE INVENTION

The present invention is a novel way of working with adjustable products. The present invention allows consumers to easily move and fix a weight at any location within a channel disposed in the golf club head in such a way to maximize aesthetic appearances while preserving the function of the movable weight. The objective of this invention is to provide an adjustable weight with minimal or no effect on appearance at address while maximizing the ability of the weight to adjust center of gravity height. Additional goals include minimizing the fixed component of the structure dedicated to the weighting system and also minimizing any potential effect on impact sound. Yet another object of the present invention is an adjustable weighting feature for lateral or vertical center of gravity control which is placed to maximize effectiveness and may be entirely concealed from view at address.

One aspect of the present invention is a golf club head comprising a body comprising a crown, a sole, a heel side, a toe side, a face portion, a rear side, an edge portion where the crown connects with the sole, a pocket, and a channel, and a weight comprising a base comprising a first threaded bore, a first cap comprising a through-bore, and a first bolt, wherein the channel comprises a first wall, a second wall, a floor, a first rail extending from the first wall, and a second rail extending from the second wall, wherein the weight is disposed within and movable to any location in the channel, wherein the base and the first cap sandwich a portion of each of the first and second rails, wherein tightening the bolt reversibly fixes the weight to the rails, wherein the pocket is sized to receive the first cap, and wherein moving the weight within the channel changes both a moment of inertia and a location of a center of gravity of the golf club head.

In some embodiments, the golf club head may comprise a second cap that fits within the pocket, and the first cap may be interchangeable with the second cap. In a further embodiment, the first cap may be composed of a first material having a first density, the second cap may be composed of a second material having a second density, and the first density may be greater than the second density. In another embodiment, the first cap may be a first color, the second cap may be a second color, and the first color may contrast with the second color. In another embodiment, the first cap may comprise a first sidewall protrusion and a second sidewall protrusion, and the pocket may comprise a floor having first and second depressions sized to receive the first and second sidewall protrusions. The bolt may connect the base to the first cap, and the base and the first cap may not make direct contact with one another.

In a further embodiment, the golf club head may comprise a second bolt, the pocket may comprise a plurality of walls, a floor, and a second threaded bore extending into the floor, and the second bolt may comprise a threaded portion sized to fit within the threaded bore. In other embodiments, each of the channel and the pocket may be disposed in the sole, and the pocket may be located proximate the face portion. The channel may, in another embodiment, be disposed proximate the rear side of the body and may extend proximate the edge portion. In another embodiment, the cap may comprise a lower cavity, and the base may be sized to fit within the lower cavity, so that the base may be hidden from view when the weight is disposed within the channel.

In some embodiments, the base may be composed of a material with a density greater than 4 g/cc, and the first cap may be composed of a material with a density less than 4 g/cc. In other embodiments, the channel may extend from the heel side towards the toe side via the rear side along one of the crown and the sole, the channel may twist relative to a plane intersecting the golf club head at the edge portion as the channel extends around the body, the channel may comprise a channel axis that extends normal to the floor of the channel, and an angle between the channel axis and the plane may not remain constant along the channel. In some embodiments, an area of a cross-section of the channel taken in a direction normal to the edge portion may be constant along the channel. In some embodiments, a heel-most end of the channel may be closer to the face than a toe-most end of the channel, and in other embodiments, a distance between the edge portion and a midpoint of the channel may remain constant for at least 50% of the length of the channel. In yet another embodiment, the golf club head may further comprise an adjustable hosel assembly, the crown may be composed of a composite material, and the sole and the face may be composed of a titanium alloy.

Another aspect of the present invention is a driver-type golf club head comprising a composite crown, a metal body comprising a sole, a heel side, a toe side, a face portion, a rear side, a pocket, and a channel, a weight comprising a base comprising a first threaded bore, a first cap comprising a through-bore, and a first bolt, and a second cap, wherein each of the channel and the pocket is disposed in the sole, wherein the weight is disposed within and movable to any location in the channel, wherein tightening the bolt reversibly fixes the weight within the channel, wherein the pocket is located proximate the face portion, wherein the second cap is disposed within the pocket, and wherein the first cap and the second cap have the same dimensions and are interchangeable. In some embodiments, the channel may comprise a first wall, a second wall, a floor, a first rail extending from the first wall, and a second rail extending from the second wall, and the base and the first cap may sandwich a portion of each of the first and second rails.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
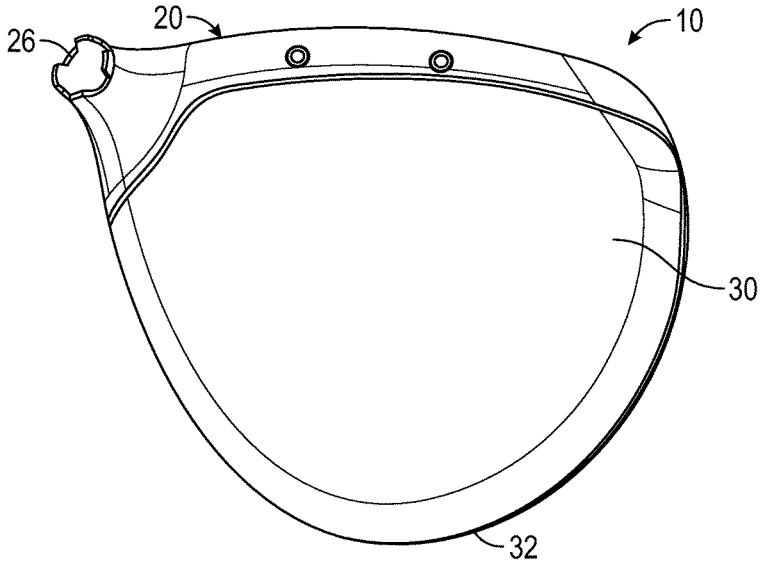
FIG. 1 is a top elevational view of a golf club head of the present invention.
Figure 2:
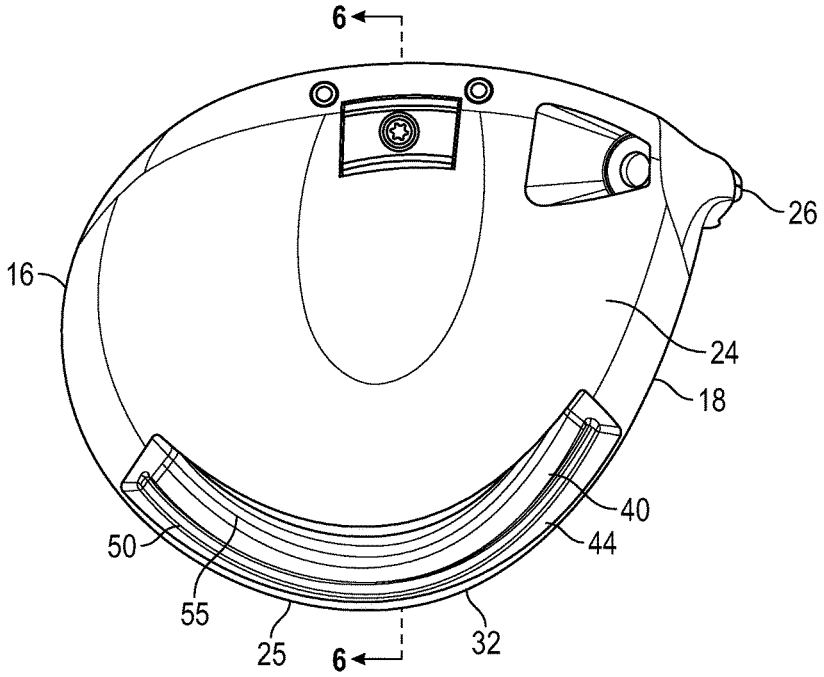
FIG. 2 is a bottom elevational view of the embodiment shown in FIG. 1 with a weight cap in the pocket.
Figure 3:
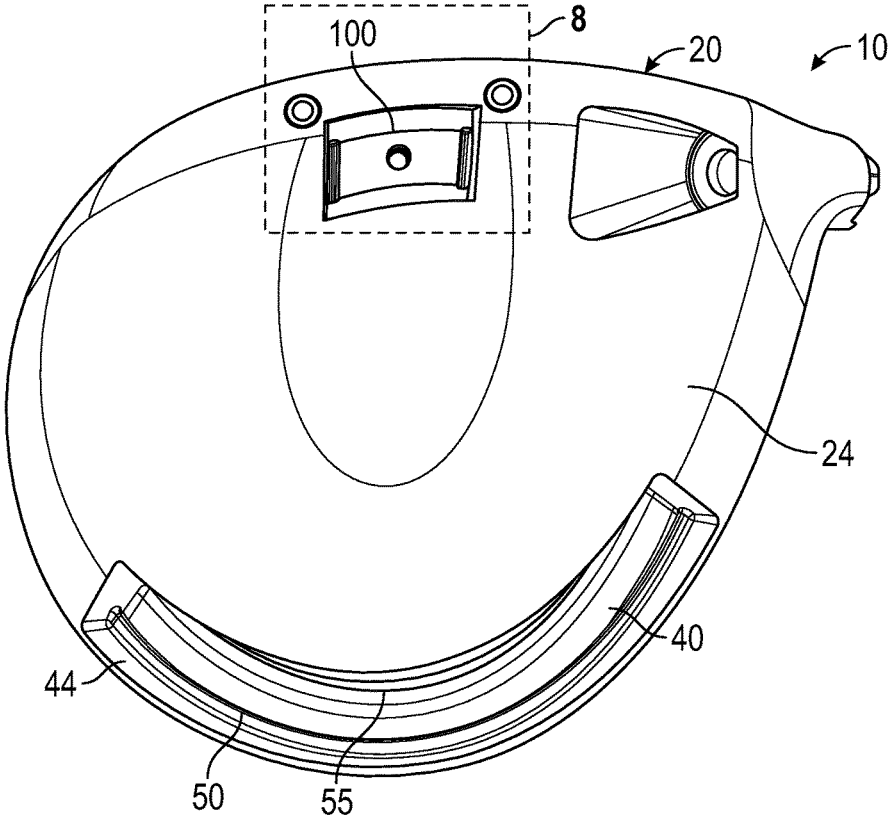
FIG. 3 is a bottom elevational view of the embodiment shown in FIG. 1 without the weight cap in the pocket.
Figure 4:
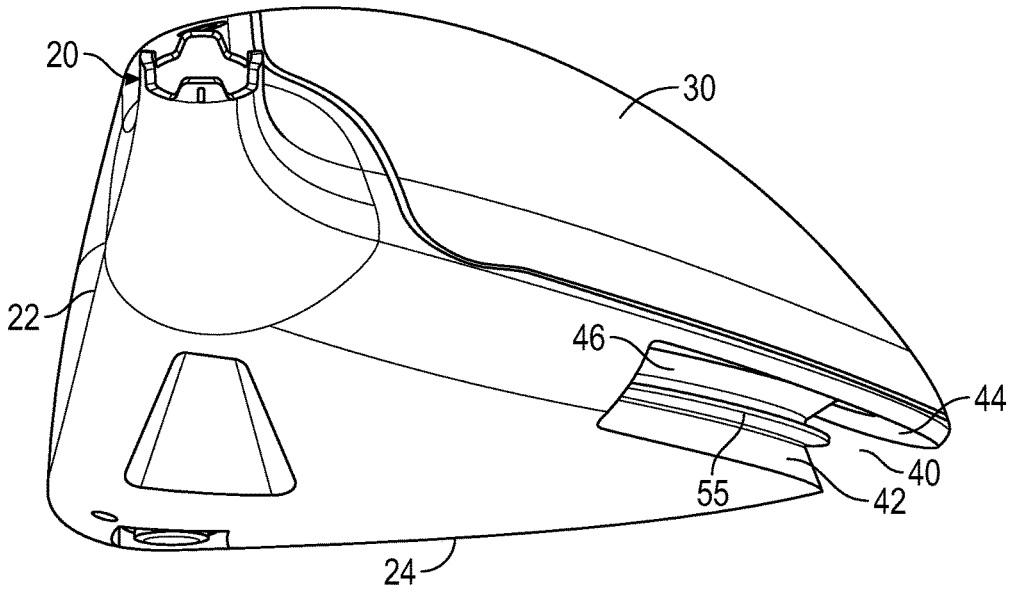
FIG. 4 is a side elevational view of the embodiment shown in FIG. 1.
Figure 5:
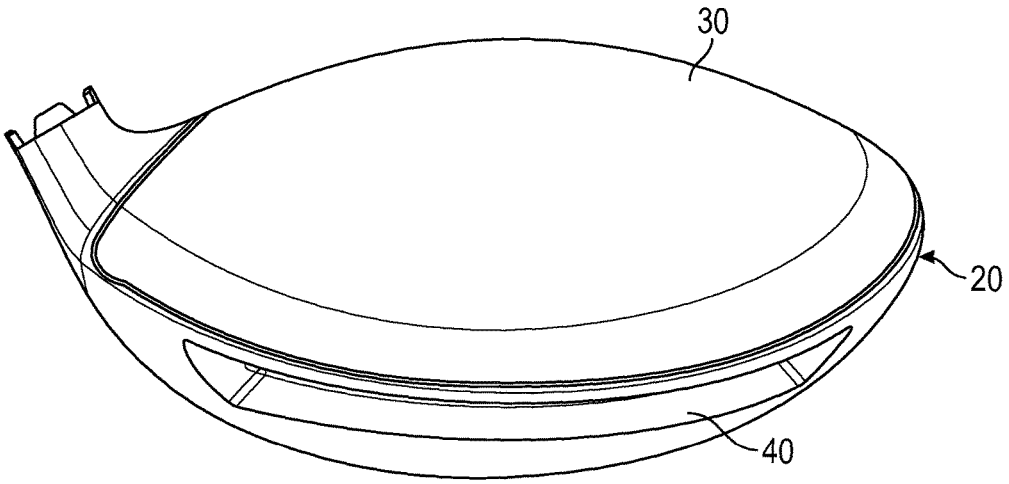
FIG. 5 is a rear perspective view of the embodiment shown in FIG. 1.
Figure 6:
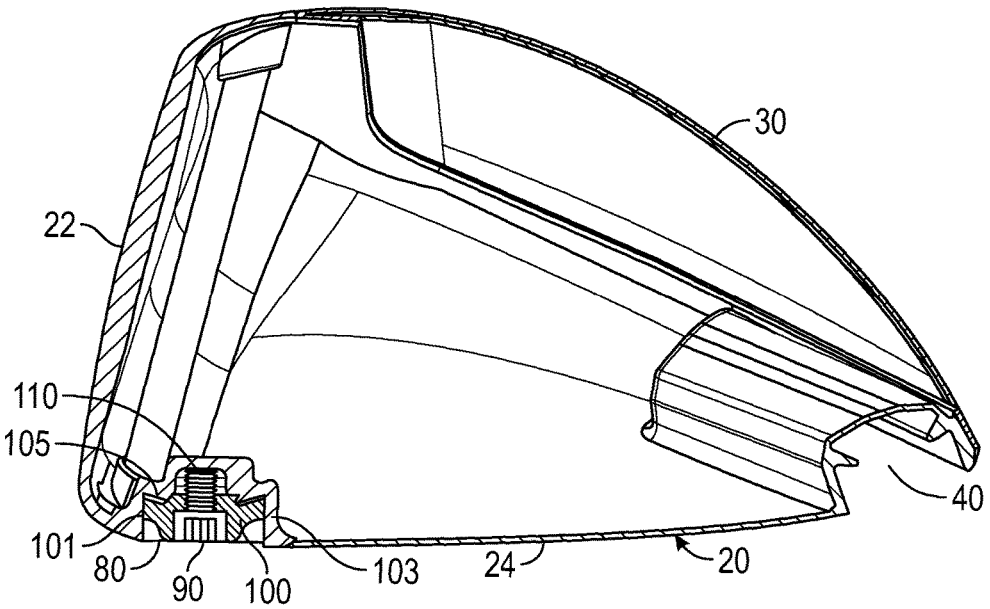
FIG. 6 is a cross-sectional view of the embodiment shown in FIG. 2 along lines 6-6.
Figure 7:
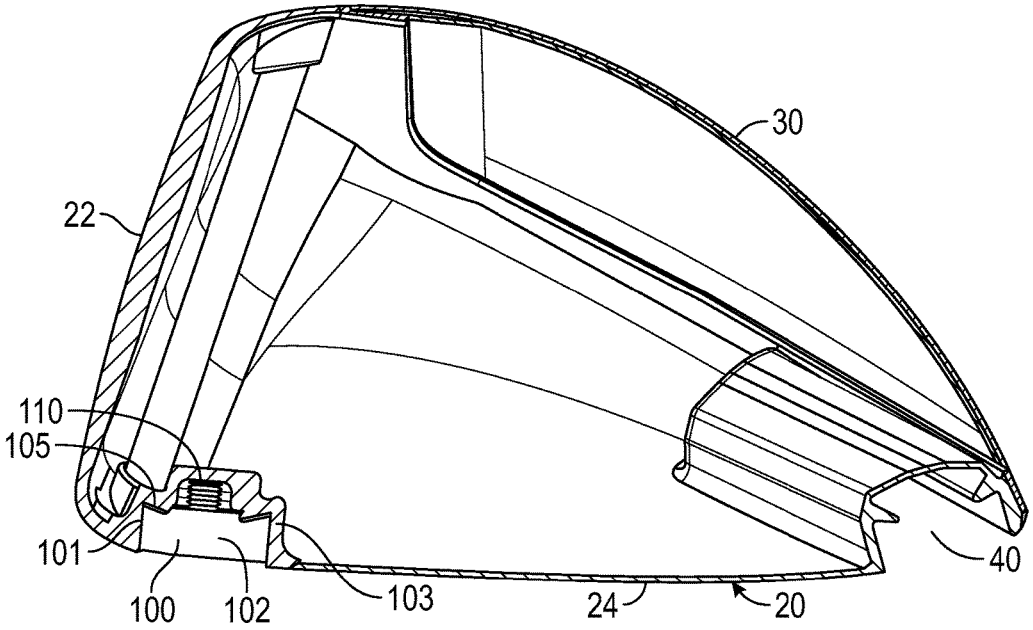
FIG. 7 is a view of the embodiment shown in FIG. 6 without the weight cap in the pocket.
Figure 8:
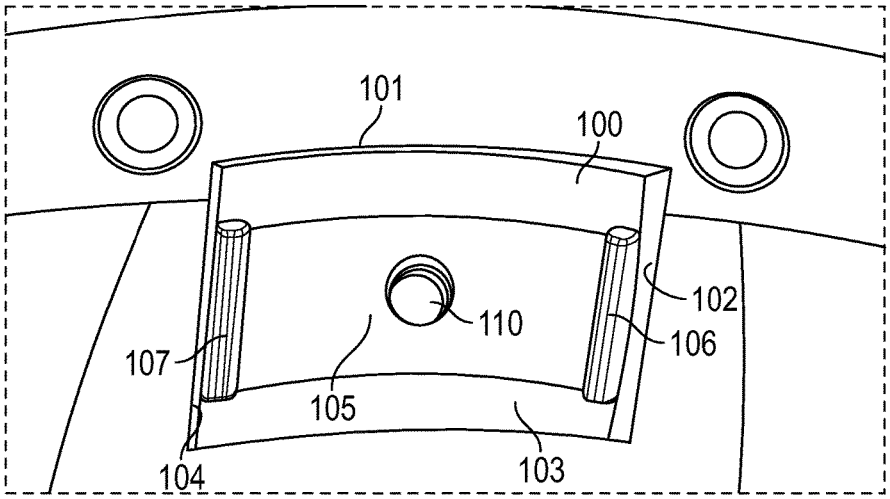
FIG. 8 is an enlarged view of the circled portion of the embodiment shown in FIG. 3.
Figure 9:
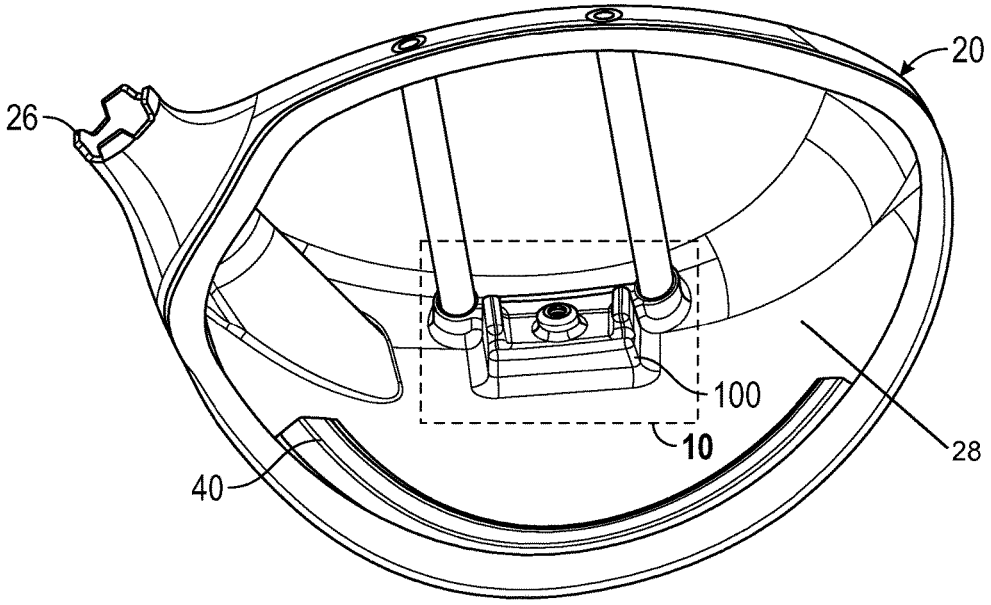
FIG. 9 is a top elevational view of the embodiment shown in FIG. 1 without the crown.
Figure 10:
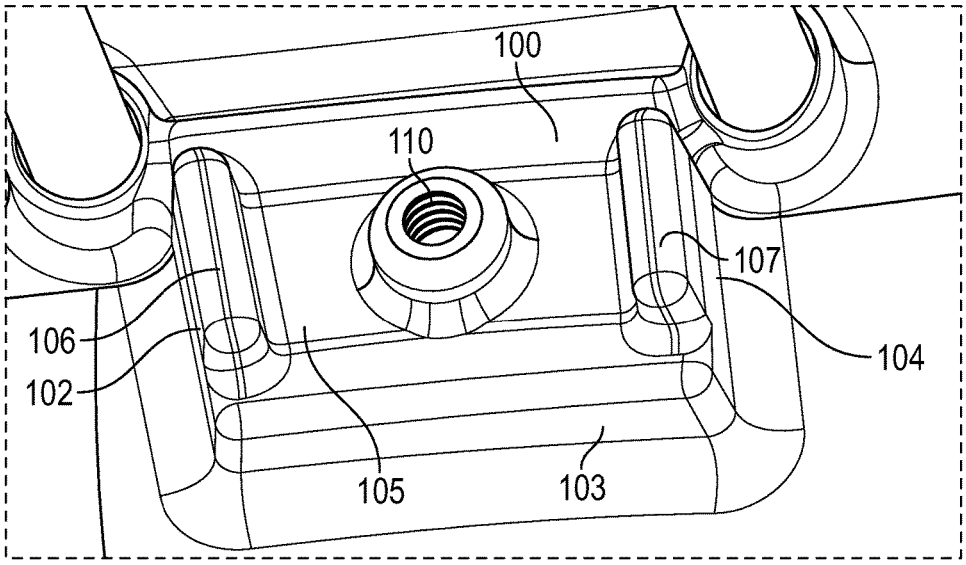
FIG. 10 is an enlarged view of the encircled portion of the embodiment shown in FIG. 9.
Figure 11:
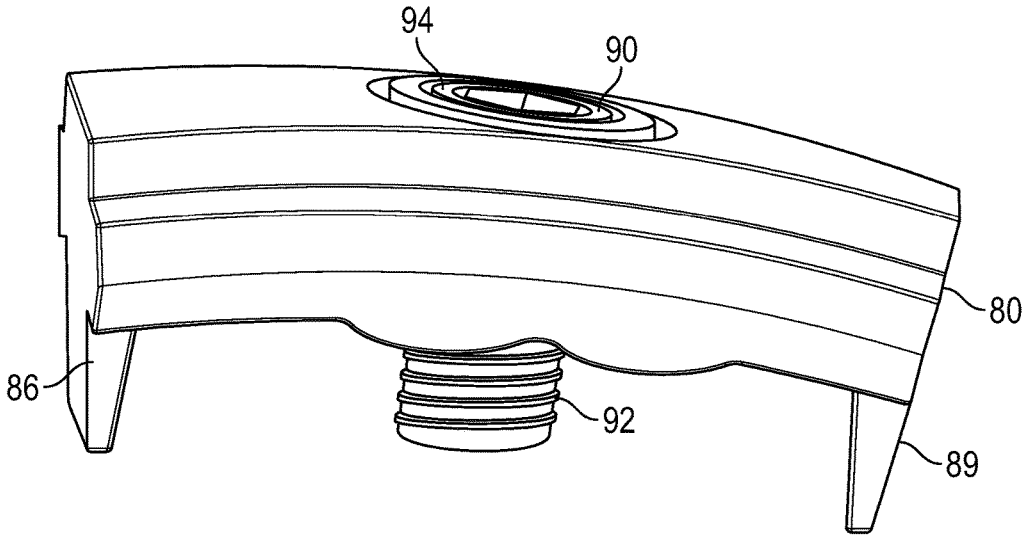
FIG. 11 is a side elevational view of the weight cap shown in FIGS. 2, 6, and 11 engaged with a bolt.
Figure 12:
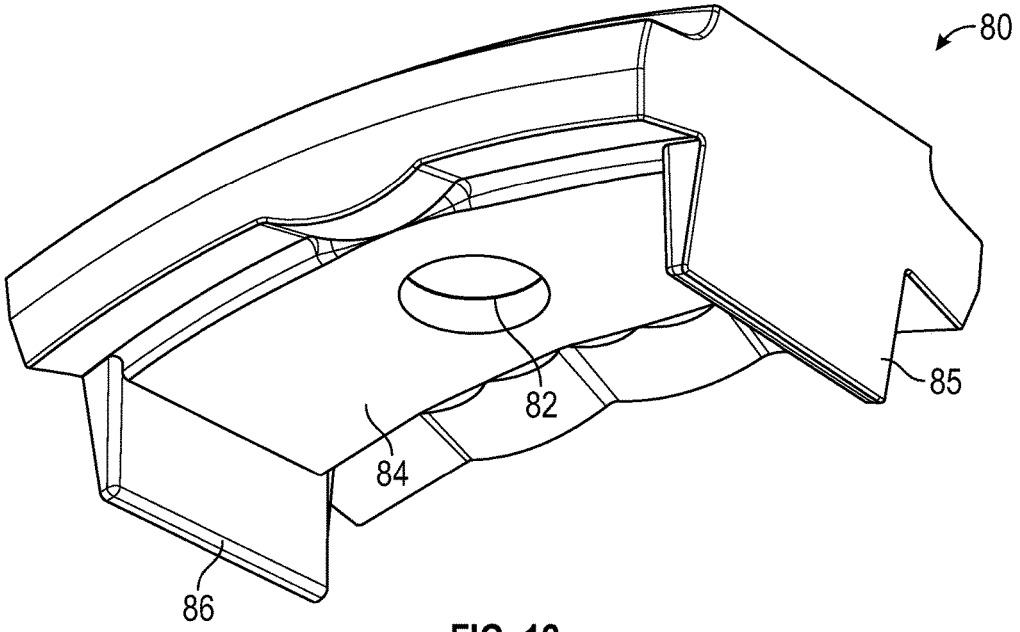
FIG. 12 is a bottom perspective view of the weight cap shown in FIGS. 2, 6, and 11.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. It can also work in conjunction with at least one adjustable weight port on the sole of the driver head. Shifting weight along the channel described herein allows for control of mass properties such as center of gravity location and moment of inertia.

A preferred embodiment of the present invention is shown in the Figures. The golf club head 10 comprises a metal body 20 with a face 22, a sole 24, a hosel 26, and an upper opening 28, and a composite crown 30 that is adhered to the body 20 and covers the upper opening 28. The golf club head 10 preferably includes, or is compatible with, an adjustable hosel assembly, including any of the embodiments disclosed in U.S. Pat. Nos. 8,002,644, 8,684,859, 8,696,486, 8,715,102, 8,715,103, 8,715,104, 8,727,906, and 8,801,537, and U.S. patent application Ser. No. 14/452,157, the disclosure of each of which is hereby incorporated by reference in its entirety herein. The golf club head 10 also preferably includes carbon tubes extending vertically between upper and lower portions of the body 20 at a hinge region proximate the face 22, as disclosed in U.S. patent application Ser. Nos. 14/847,227, 14/788,326, and 14/794,578, the disclosure of each of which is hereby incorporated by reference in its entirety herein.

A channel 40 is disposed at a rear portion 25 of the sole 24, near an edge region 32 where the crown 30 connects to the sole 24, but may, in alternative embodiments, be disposed within a side or ribbon portion of the golf club head, or in the crown 30. The channel 40 extends from a toe side 16 to a heel side 18 of the rear portion 25, and has an approximately square cross-sectional shape, with first and second side walls 42, 44, a floor 46, and a pair of rails 50, 55 extending from the side walls 42, 44 and across the length of the channel 40.

Figure 13:
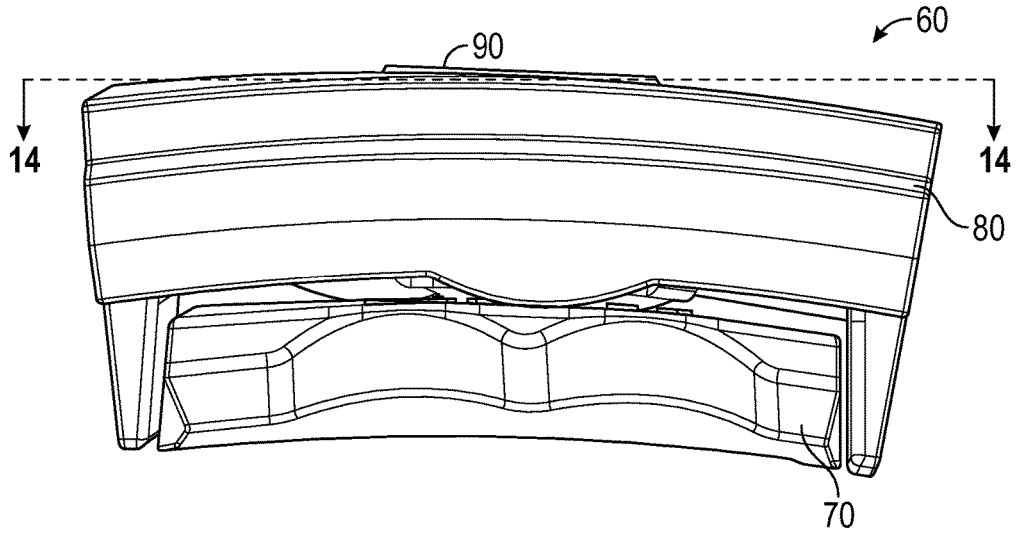
FIG. 13 is a side elevational view of the fully assembled slidable weight.
Figure 14:
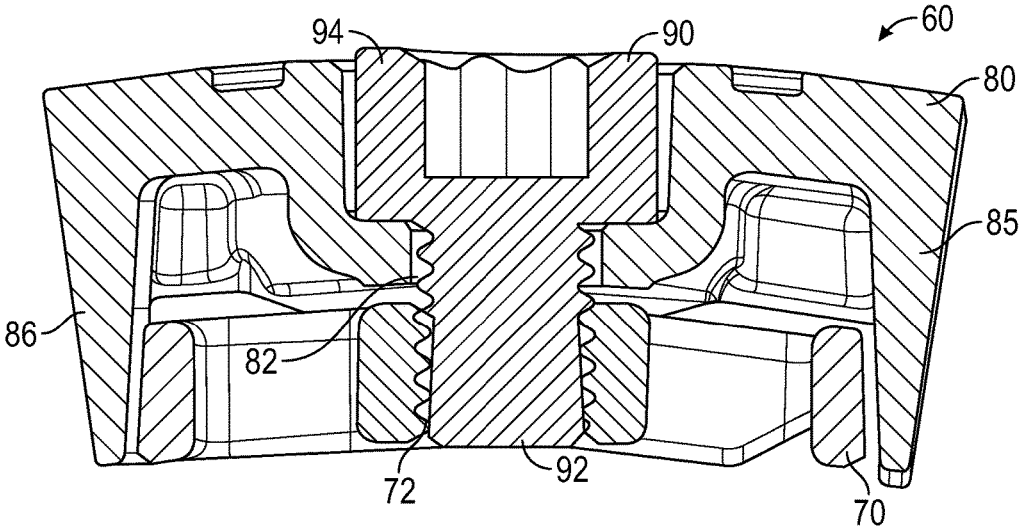
FIG. 14 is a cross-sectional view of the slidable weight shown in FIG. 13 along lines 14-14.
Figure 15:
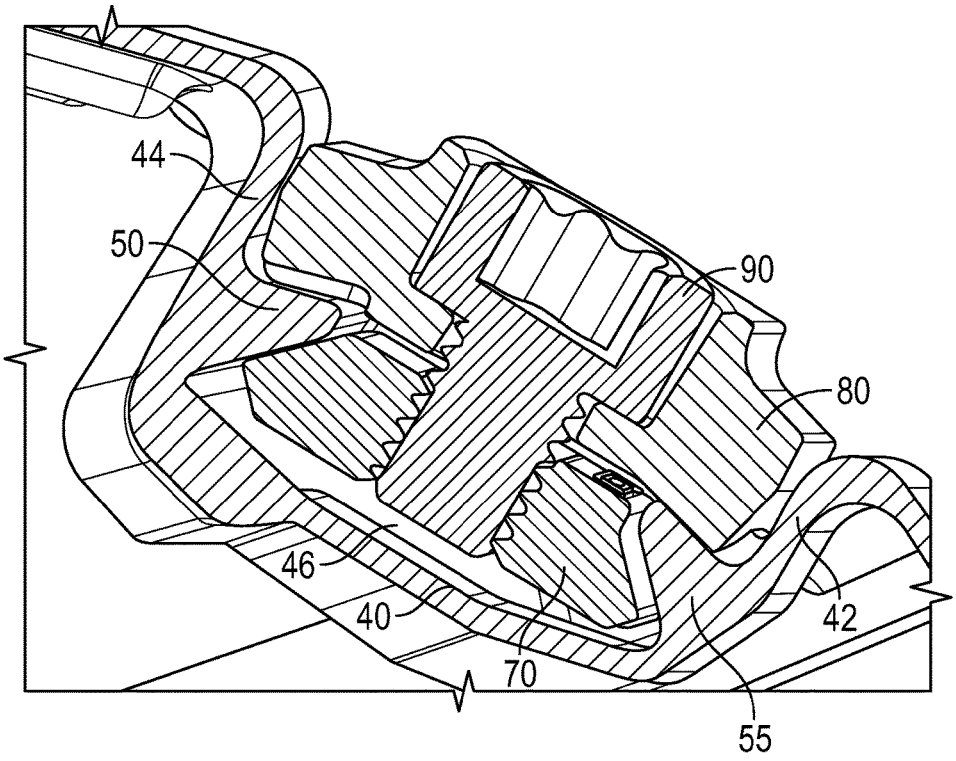
FIG. 15 is a cross-sectional view of the slidable weight shown in FIG. 13 engaged with the channel.

A slidable weight 60 is disposed within the channel 40 and is movable to any location therein. As shown in FIGS. 13-15, the slidable weight 60 comprises a base portion 70, a cap 80, and a bolt 90 that connects the base portion 70 to the cap 80. The base portion 70 comprises a threaded through-bore 72 sized to receive the threaded portion 92 of the bolt 90, which extends through a central area 74 of the base portion 70. The base portion 70 is sized to fit within a lower cavity 84 of the cap 80, such that it is completely obscured from view when the weight 60 is engaged with the channel 40. The cap 80 comprises a through-bore 82 sized to receive the threaded portion 92, but not the head 94, of the bolt 90, and a lower cavity 84 created by two side wall extensions 85, 86 on opposite ends of the cap 80. When the weight 60 is assembled within the channel 40, as shown in FIG. 15, the base portion 70 is disposed below the rails 50, 55 and most of the cap 80 is disposed above the rails 50, 55, such that the base portion 70 and cap 80 sandwich the rails 50, 55 between them. The rails 50, 55 prevent the cap 80 from making contact with the base portion 70 when the weight 60 is disposed within the channel 40. While the base portion 70 and the cap 80 may have the same material composition, the base portion 70 preferably is composed of a denser material, such as steel or tungsten alloy, than the cap 80, which preferably is composed of a lightweight material such as aluminum alloy, plastic, or composite.

As shown in FIGS. 3 and 6-10, the golf club head 10 of the present invention also includes a shallow pocket 100, which preferably is disposed in a central location of the sole 24 proximate the face 22. The pocket 100, which is approximately rectangular in shape and comprises four walls 101, 102, 103, 104, a floor 105, a pair of depressions 106, 107, and a threaded bore 110, is sized to receive the cap 80. When the cap 80 is placed within the pocket 100, each side wall extension 85, 86 is received in a depression 106, 107, the through-bore 82 lines up with the threaded bore 110, and a bolt 90 is threaded through the through-bore 82 and into the threaded bore 110 to removably secure the cap 80 within the pocket 100.

The pocket 100 provides an added element of adjustability to the golf club head 100 of the present invention, as it can hold an extra cap 80 that can be swapped out with the cap 80 used with the weight 60. This alternative cap 80 can be made of a different material, or have a different density, than the cap 80 used with the weight 60, and functions as weighting element, thus changing the mass properties of the golf club head 10 when disposed within the pocket 100. The alternative cap 80 can also have a different color and/or markings than the cap 80 provided with the weight 60, such that a user can distinguish between the two caps 80 and decide which to use with the slidable weight 60 and which to store in the pocket 100.

Figure 16:
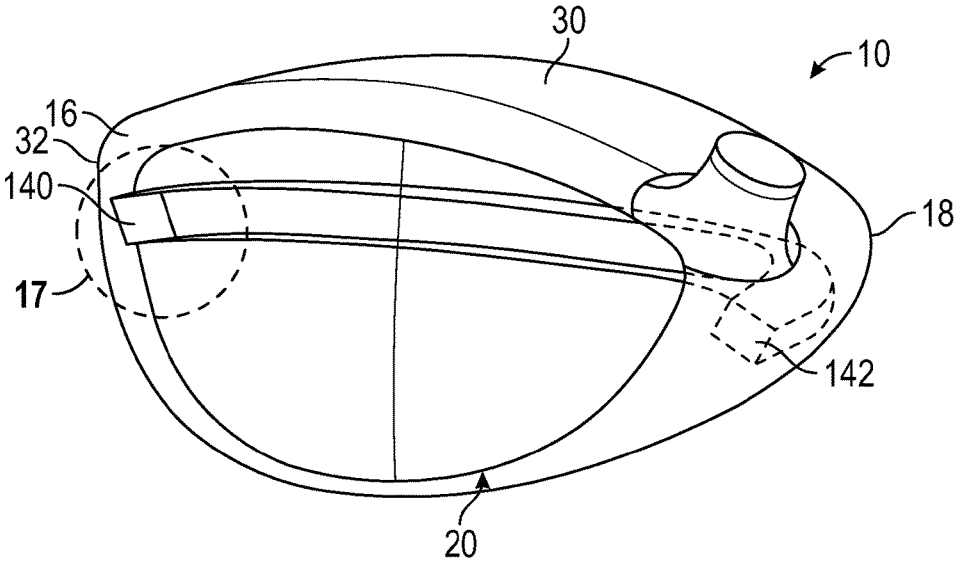
FIG. 16 is a transparent, wire-frame drawing of the embodiment shown in FIG. 1 including a solid shape representing the empty volume or negative space of the channel.
Figure 17:
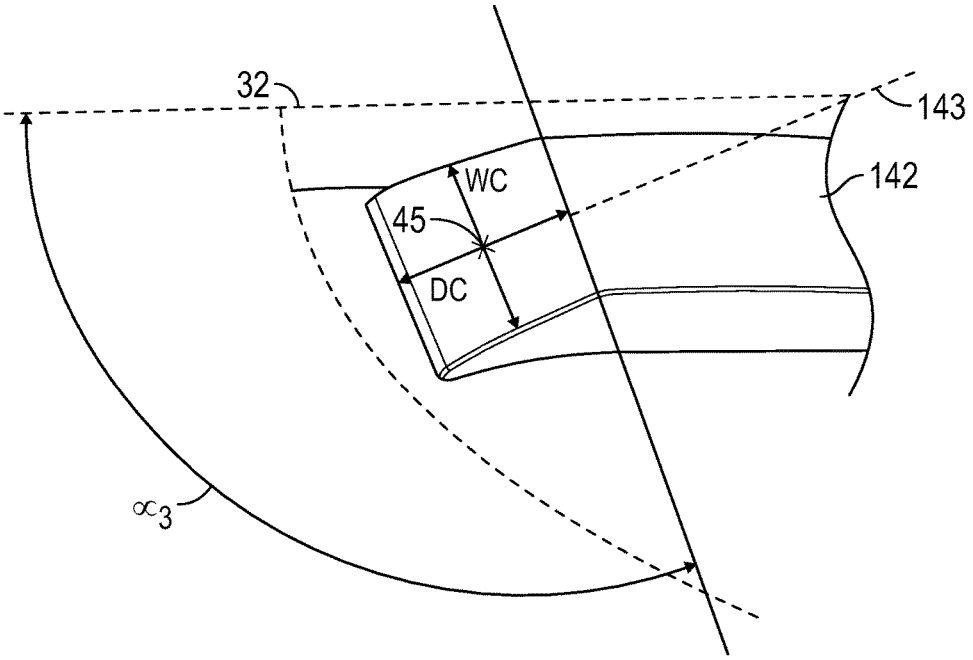
FIG. 17 is an enlarged view of the circled portion of the golf club head shown in FIG. 16, and focuses on the negative space of a small section of the channel.
Figure 18:
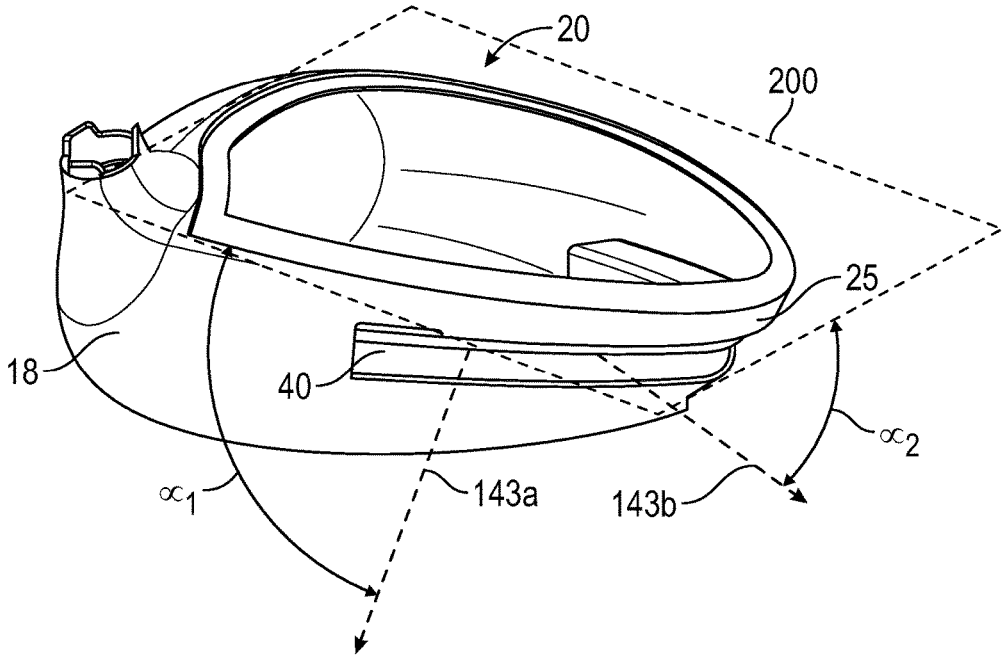
FIG. 18 is a side perspective view of the embodiment shown in FIG. 1 without the crown.

The channel 40 of the preferred embodiment is novel because its curvature is not constrained to a planar arc, e.g., an arc entirely located within a single plane that intersects the golf club head. An example of a prior art club design having a channel that follows a planar arc is shown in FIG. 1 of U.S. Pat. No. 7,775,905 to Beach et al. Instead, the channel 40 of the present invention twists as it follows the contours of the golf club head body, a characteristic that is illustrated in FIGS. 16 and 17, each of which includes a representation of the empty (negative) space 140 of the channel 40, defined by the channel walls 42, 44 in the sole 24, and FIG. 18. As shown in these Figures, the inner portion 142 of the negative space 140 that represents the floor 46 of the channel 40 constantly changes the direction in which it faces. More specifically, at each location along the channel 40, the channel 40 comprises an axis 143 that extends normal to the inner portion 142. The orientation of this axis 143 with respect to a plane 200 that intersects the inner portion 142, shown in FIG. 18, changes along the length of the channel 40. For example, as shown in FIG. 18 at the heel side 18 of the body 20, the axis 143*a* is oriented at angle $\alpha 1$ with respect to the plane 200, while at the rear portion 25 of the body 20, the axis 143*b* is oriented at smaller angle $\alpha 2$ with respect to the plane 20. This novel channel 40 orientation allows the channel 40 to closely follow the contours, and preserve the overall aesthetics, of the body 20 of the golf club head 10.

The channel's 40 preferred dimensions are shown in more detail in FIG. 17. At any section taken normal to the channel 40, the channel 40 has a diameter or depth $D_C$ that ranges from 0.250 inch to 0.750 inch, more preferably from 0.400 to 0.600 inch, and most preferably approximately 0.450 inch, and a width $W_C$ that preferably is approximately the same as the depth $D_C$, but may differ from the depth and may range from 0.250 inch to 0.750 inch, more preferably from 0.400 to 0.600 inch, and most preferably approximately 0.450 inch. The channel 40 preferably has a midpoint 48 that is horizontally spaced from the edge region 32 by 0.200 inch to 0.500 inch, more preferably 0.300 to 0.400 inch, and most preferably approximately 0.385 inch. The midpoint 45 of the channel 40 also is vertically spaced from the edge region 32 by approximately 0.100 to 0.400 inch, more preferably 0.200 to 0.300 inch, and most preferably approximately 0.274 inch. These depth $D_C$ and width $W_C$ dimensions preferably remain constant across the channel 40, such that a cross section of the channel 40 taken normal to the edge region 32 at any location along the channel 40 will have the same area. Similarly, the distance between the edge region 32 and the midpoint 45 of the channel 40 should be the same for at least 50% of the locations across the length of the channel 40. In the cross-section of the channel 40 shown in FIG. 17, the floor 46 of the channel 40 has an angle $\alpha 3$ of 113° with respect to the edge region 32, though this value changes depending on where along the channel 40 the angle is measured.

In alternative embodiments, the channel 40 of the present invention may be disposed in the sole 24 perpendicular to the face 22. In other embodiments, the channel 40 may extend from the sole 24 to the crown 30 or be disposed entirely on the crown 30.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a crown, a sole, a heel side, a toe side, a face portion, a rear side, an edge portion where the crown connects with the sole, a pocket, and a channel;

a weight comprising a base comprising a first threaded bore, a first cap comprising a through-bore, and a first bolt; and a second cap, wherein the channel comprises a first wall, a second wall, a floor, a first rail extending from the first wall, and a second rail extending from the second wall, wherein the weight is disposed within and movable to any location in the channel, wherein the base and the first cap sandwich a portion of each of the first and second rails, wherein tightening the bolt reversibly fixes the weight to the rails, wherein the pocket is sized to receive the first cap, wherein the second cap fits within the pocket, wherein the first cap is interchangeable with the second cap, and wherein moving the weight within the channel changes both a moment of inertia and a location of a center of gravity of the golf club head.

2. The golf club head of claim 1, wherein the first cap is composed of a first material having a first density, wherein the second cap is composed of a second material having a second density, and wherein the first density is greater than the second density.

3. The golf club head of claim 2, wherein the first cap has a first color, wherein the second cap has a second color, and wherein the first color contrasts with the second color.

4. A golf club head comprising:

a body comprising a crown, a sole, a heel side, a toe side, a face portion, a rear side, an edge portion where the crown connects with the sole, a pocket, and a channel; and a weight comprising a base comprising a first threaded bore, a first cap comprising a through-bore, and a first bolt, wherein the first cap comprises a first sidewall protrusion and a second sidewall protrusion, wherein the channel comprises a first wall, a second wall, a floor, a first rail extending from the first wall, and a second rail extending from the second wall, wherein the weight is disposed within and movable to any location in the channel, wherein the base and the first cap sandwich a portion of each of the first and second rails, wherein tightening the bolt reversibly fixes the weight to the rails, wherein the pocket is sized to receive the first cap and comprises a floor having first and second depressions sized to receive the first and second sidewall protrusions, and wherein moving the weight within the channel changes both a moment of inertia and a location of a center of gravity of the golf club head.

5. A golf club head comprising:

a body comprising a crown, a sole, a heel side, a toe side, a face portion, a rear side, an edge portion where the crown connects with the sole, a pocket, and a channel; and a weight comprising a base comprising a first threaded bore, a first cap comprising a through-bore, and a first bolt, wherein the bolt connects the base to the first cap, wherein the base and the first cap do not make direct contact with one another, wherein the channel comprises a first wall, a second wall, a floor, a first rail extending from the first wall, and a second rail extending from the second wall, wherein the weight is disposed within and movable to any location in the channel, wherein the base and the first cap sandwich a portion of each of the first and second rails, wherein tightening the bolt reversibly fixes the weight to the rails, wherein the pocket is sized to receive the first cap, and wherein moving the weight within the channel changes both a moment of inertia and a location of a center of gravity of the golf club head.

6. A golf club head comprising:

a body comprising a crown, a sole, a heel side, a toe side, a face portion, a rear side, an edge portion where the crown connects with the sole, a pocket, and a channel;

a weight comprising a base comprising a first threaded bore, a first cap comprising a through-bore, and a first bolt; and a second bolt, wherein the channel comprises a first wall, a second wall, a floor, a first rail extending from the first wall, and a second rail extending from the second wall, wherein the weight is disposed within and movable to any location in the channel, wherein the base and the first cap sandwich a portion of each of the first and second rails, wherein tightening the bolt reversibly fixes the weight to the rails, wherein the pocket comprises a plurality of walls, a floor, and a second threaded bore extending into the floor, wherein the pocket is sized to receive the first cap, wherein the second bolt comprises a threaded portion sized to fit within the threaded bore, and wherein moving the weight within the channel changes both a moment of inertia and a location of a center of gravity of the golf club head.

7. A golf club head comprising:

a body comprising a crown, a sole, a heel side, a toe side, a face portion, a rear side, an edge portion where the crown connects with the sole, a pocket, and a channel; and a weight comprising a base comprising a first threaded bore, a first cap comprising a through-bore, and a first bolt, wherein the channel comprises a first wall, a second wall, a floor, a first rail extending from the first wall, and a second rail extending from the second wall, wherein the weight is disposed within and movable to any location in the channel, wherein the base and the first cap sandwich a portion of each of the first and second rails, wherein tightening the bolt reversibly fixes the weight to the rails, wherein each of the channel and the pocket is disposed in the sole, wherein the pocket is located proximate the face portion and is sized to receive the first cap, and wherein moving the weight within the channel changes both a moment of inertia and a location of a center of gravity of the golf club head.

8. The golf club head of claim 7, wherein the channel is disposed proximate the rear side of the body and extends proximate the edge portion.

9. A golf club head comprising:

a body comprising a crown, a sole, a heel side, a toe side, a face portion, a rear side, an edge portion where the crown connects with the sole, a pocket, and a channel; and a weight comprising a base comprising a first threaded bore, a first cap comprising a through-bore, and a first bolt, wherein the cap comprises a lower cavity, wherein the base is sized to fit within the lower cavity, wherein the channel comprises a first wall, a second wall, a floor, a first rail extending from the first wall, and a second rail extending from the second wall, wherein the weight is disposed within and movable to any location in the channel, wherein the base and the first cap sandwich a portion of each of the first and second rails, wherein tightening the bolt reversibly fixes the weight to the rails, wherein the pocket is sized to receive the first cap, and wherein moving the weight within the channel changes both a moment of inertia and a location of a center of gravity of the golf club head.

10. The golf club head of claim 9, wherein the base is hidden from view when the weight is disposed within the channel.

11. A golf club head comprising:

a body comprising a crown, a sole, a heel side, a toe side, a face portion, a rear side, an edge portion where the crown connects with the sole, a pocket, and a channel; and a weight comprising a base comprising a first threaded bore, a first cap comprising a through-bore, and a first bolt, wherein the base is composed of a material with a density greater than 4 g/cc, wherein the first cap is composed of a material with a density less than 4 g/cc, wherein the channel comprises a first wall, a second wall, a floor, a first rail extending from the first wall, and a second rail extending from the second wall, wherein the weight is disposed within and movable to any location in the channel, wherein the base and the first cap sandwich a portion of each of the first and second rails, wherein tightening the bolt reversibly fixes the weight to the rails, wherein the pocket is sized to receive the first cap, and wherein moving the weight within the channel changes both a moment of inertia and a location of a center of gravity of the golf club head.

12. A golf club head comprising:

a body comprising a crown, a sole, a heel side, a toe side, a face portion, a rear side, an edge portion where the crown connects with the sole, a pocket, and a channel extending from the heel side towards the toe side via the rear side along one of the crown and the sole; and a weight comprising a base comprising a first threaded bore, a first cap comprising a through-bore, and a first bolt, wherein the channel comprises a first wall, a second wall, a floor, a first rail extending from the first wall, and a second rail extending from the second wall, wherein the channel twists relative to a plane intersecting the golf club head at the edge portion as the channel extends around the body, wherein the channel comprises a channel axis that extends normal to the floor of the channel, wherein an angle between the channel axis and the plane does not remain constant along the channel, wherein the weight is disposed within and movable to any location in the channel, wherein the base and the first cap sandwich a portion of each of the first and second rails, wherein tightening the bolt reversibly fixes the weight to the rails, wherein the pocket is sized to receive the first cap, and wherein moving the weight within the channel changes both a moment of inertia and a location of a center of gravity of the golf club head.

13. A golf club head comprising:

a body comprising a crown, a sole, a heel side, a toe side, a face portion, a rear side, an edge portion where the crown connects with the sole, a pocket, and a channel; and a weight comprising a base comprising a first threaded bore, a first cap comprising a through-bore, and a first bolt, wherein the channel comprises a first wall, a second wall, a floor, a first rail extending from the first wall, and a second rail extending from the second wall, wherein a heel-most end of the channel is closer to the face than a toe-most end of the channel, wherein the weight is disposed within and movable to any location in the channel, wherein the base and the first cap sandwich a portion of each of the first and second rails, wherein tightening the bolt reversibly fixes the weight to the rails, wherein the pocket is sized to receive the first cap, and wherein moving the weight within the channel changes both a moment of inertia and a location of a center of gravity of the golf club head.

14. A golf club head comprising:

a body comprising a crown, a sole, a heel side, a toe side, a face portion, a rear side, an edge portion where the crown connects with the sole, a pocket, and a channel; and a weight comprising a base comprising a first threaded bore, a first cap comprising a through-bore, and a first bolt, wherein the channel comprises a first wall, a second wall, a floor, a first rail extending from the first wall, and a second rail extending from the second wall, wherein a distance between the edge portion and a mid-point of the channel remains constant for at least 50% of the length of the channel, wherein the weight is disposed within and movable to any location in the channel, wherein the base and the first cap sandwich a portion of each of the first and second rails, wherein tightening the bolt reversibly fixes the weight to the rails, wherein the pocket is sized to receive the first cap, and wherein moving the weight within the channel changes both a moment of inertia and a location of a center of gravity of the golf club head.

15. The golf club head of claim 1, further comprising an adjustable hosel assembly.

16. The golf club head of claim 1, wherein the crown is composed of a composite material, and wherein the sole and the face are composed of a titanium alloy.

17. The golf club head of claim 1, wherein an area of a cross-section of the channel taken in a direction normal to the edge portion is constant along the channel.

18. A driver-type golf club head comprising:

a composite crown;

a metal body comprising a sole, a heel side, a toe side, a face portion, a rear side, a rectangular pocket, and a channel;

a weight comprising a base comprising a first threaded bore, a first cap comprising a through-bore, and a first bolt; and a second cap, wherein each of the channel and the pocket is disposed in the sole, wherein the weight is disposed within and movable to any location in the channel, wherein tightening the bolt reversibly fixes the weight within the channel, wherein the pocket is located proximate the face portion, wherein the second cap is disposed within the pocket, and wherein the first cap and the second cap have the same dimensions and are interchangeable.

19. The driver-type golf club head of claim 18, wherein the channel comprises a first wall, a second wall, a floor, a first rail extending from the first wall, and a second rail extending from the second wall, and wherein the base and the first cap sandwich a portion of each of the first and second rails.

* * * * *